US007500563B2

(12) United States Patent
Baehler et al.

(10) Patent No.: US 7,500,563 B2
(45) Date of Patent: Mar. 10, 2009

(54) PORTABLE WALK-IN STORAGE AND MOVING CONTAINERS AND METHOD OF STACKING THE SAME

(76) Inventors: Patrick George Baehler, 614 Claymont Dr., Ballwin, MO (US) 63011; Darrell Haire, 408 W. Hunting Ridge Dr., Thomasville, NC (US) 27360; Larry Hartog, 7111 Branden Dr., Georgetown, IN (US) 47122

( * ) Notice: Subject to any disclaimer, the term of this patent is extended or adjusted under 35 U.S.C. 154(b) by 512 days.

(21) Appl. No.: 11/271,452

(22) Filed: Nov. 11, 2005

(65) Prior Publication Data

US 2007/0108082 A1 May 17, 2007

(51) Int. Cl.
*B65D 21/02* (2006.01)
*B65D 85/62* (2006.01)

(52) U.S. Cl. ..... 206/509; 220/1.5

(58) Field of Classification Search ..... 220/1.5; 215/503, 509, 511, 512; 206/503, 509, 511, 206/512
See application file for complete search history.

(56) References Cited

U.S. PATENT DOCUMENTS 1,912,847 A 6/1933 Klepel
2,664,219 A 12/1953 Schmidt
3,410,439 A 11/1968 Burda et al.
3,499,694 A * 3/1970 Coppell ..... 312/35
3,522,955 A 8/1970 Warner, Jr. et al.
5,085,448 A 2/1992 Shubin
5,255,806 A 10/1993 Korzeniowski et al.
5,601,201 A 2/1997 Looker
5,761,854 A 6/1998 Johnson et al.
5,785,328 A 7/1998 Eckloff
5,928,735 A 7/1999 Padmanabhan et al.
6,193,247 B1 2/2001 Spear et al.
6,374,546 B1 4/2002 Fecko et al.
7,074,004 B2 7/2006 Lockamy et al.
2004/0187402 A1 9/2004 Moon et al.
2006/0030254 A1 * 2/2006 Norris, Jr. ..... 454/118
2006/0045682 A1 3/2006 Norris, Jr.

* cited by examiner

*Primary Examiner*—Anthony D Stashick
*Assistant Examiner*—Harry A Grosso

(57) ABSTRACT

An improved walk-in storage and moving container comprises protrusions extending upward from the corners of a top wall of the container. The protrusions facilitate the stacking of one such storage container on top of another by aiding in aligning the storage containers relative to each other.

17 Claims, 4 Drawing Sheets

PORTABLE WALK-IN STORAGE AND MOVING CONTAINERS AND METHOD OF STACKING THE SAME

FIELD OF THE INVENTION

The present invention pertains to portable walk-in storage and moving containers. More particularly, the present invention pertains to stackable walk-in storage and moving containers and to methods of stacking such containers.

BACKGROUND OF THE INVENTION

It has become increasingly common for companies to lease portable walk-in storage and moving containers to commercial entities and individuals. Such storage containers provide sheltered and secure storage space to business entities and individuals at relatively low costs. Additionally, the portable nature of walk-in storage and moving containers also makes such containers convenient for moving items and for storing items off-site.

Lessors of storage and moving containers often simply deliver and retrieve the containers to lessees premises. This allows the lessees to load or unload the containers at times most convenient to the lessees. This also avoids costs associated with having the lessors perform the loading and unloading of items into and out of the containers. Still further, items can be stored long-term in portable walk-in storage and moving containers economically. In many cases, lessors of storage and moving containers offer off-site long-term storage services.

SUMMARY OF THE INVENTION

The present invention is directed to an improved walk-in storage and moving container and a method of stacking such container atop a similar storage container.

In one aspect of the invention, a first storage container comprises a horizontally oriented rectangular bottom wall. The bottom wall has four corners, a front edge, a rear edge, and opposite side edges. The side edges have a length that defines the length of the first storage container. The front and rear edges having a length that defines the width of the first storage container.

The first storage container also comprises a horizontally oriented rectangular top wall. The top wall has a front edge, a rear edge, and opposite side edges. The side edges of the top wall have a length equal to the length of the first storage container. The front and rear edges of the top wall have a length equal to the width of the first storage container.

Additionally, the first storage container comprises opposite rectangular side walls. One of the side walls extends vertically from one of the side edges of the bottom wall to one of the side edges of the top wall and the other of the side walls extends vertically from the other of the side edges of the bottom wall to the other of the side edges of the top wall. Each of the side walls has vertically oriented front and rear edges. The front and rear edges of the side walls have a height that defines the height of the first storage container.

Furthermore, the first storage container comprises a storage compartment bound by the top, bottom, and opposite side walls of the first storage container and a doorway that extends into the storage compartment from an environment external to the first storage container. The doorway is positioned between the front edge of the bottom wall and the front edge of the top wall and between the front edges of the side walls.

Still further, the first storage container comprises at least four supports. Each of the supports extends down from the bottom wall adjacent a different one of the corners of the bottom wall. The supports are adapted and configured in a manner such that, when the first storage container is at rest on a horizontal surface, the bottom wall of the first storage container is spaced above and apart from the horizontal surface.

Additionally, the first storage container comprises at least a first protrusion extending upward from the top wall of the first storage container. The first protrusion is configured and adapted to engage a first support of a second storage container that is identical to the first storage container, when such a second storage container is resting on top of the first storage container, in a manner limiting horizontal translation of the second storage container relative to the first storage container in at least first and second opposite directions. It should be appreciated that the first support of the second storage container corresponds to one of the supports of the first storage container.

In another aspect of the invention, a method comprises a step of providing first and second storage containers. Each of the first and second storage containers comprises a horizontally oriented rectangular bottom wall. The bottom wall has four corners, a front edge, a rear edge, and opposite side edges. The side edges have a length that defines the length of the respective storage container. The front and rear edges have a length that defines the width of the respective storage container.

Each of the first and second containers further comprises a horizontally oriented rectangular top wall. The top wall has a front edge, a rear edge, and opposite side edges. The side edges of the top wall have a length equal to the length of the respective storage container. The front and rear edges of the top wall have a length equal to the width of the respective storage container.

Additionally, each of the first and second containers comprises opposite rectangular side walls. One of the side walls extends vertically from one of the side edges of the bottom wall of the respective storage container to one of the side edges of the top wall of said storage container and the other of the side walls extends vertically from the other of the side edges of the bottom wall of said storage container to the other of the side edges of the top wall of said storage container. Each of the side walls has vertically oriented front and rear edges. The front and rear edges of the side walls have a height that defines the height of the respective storage container.

Furthermore, each of the first and second containers comprises a storage compartment bound by the top, bottom, and opposite side walls of the respective storage container and a doorway that extends into the storage compartment from an environment external to the respective storage container. The doorway is positioned between the front edge of the bottom wall and the front edge of the top wall and between the front edges of the side walls.

Still further, each of the first and second storage containers comprises at least four supports. Each of the supports extends down from the bottom wall of the respective storage container adjacent a different one of the corners of said bottom wall. The supports are adapted and configured in a manner such that, when the respective storage container is at rest on a horizontal surface, the bottom wall of said storage container is spaced above and apart from the horizontal surface. The first storage container comprises at least a first protrusion extending upward from the top wall of the first storage container.

This method also comprises a step of stacking the second storage container on top of the first storage container. This is performed in a manner using at least the first protrusion to limit horizontal translation of the second storage container relative to the first storage container in at least a first direction by engaging a first one of the supports of the second storage container with the first protrusion of the first storage container.

While the principal advantages and features of the invention have been described above, a more complete and thorough understanding of the invention may be obtained by referring to the drawings and the detailed description of the preferred embodiment, which follow.

Figure 1:
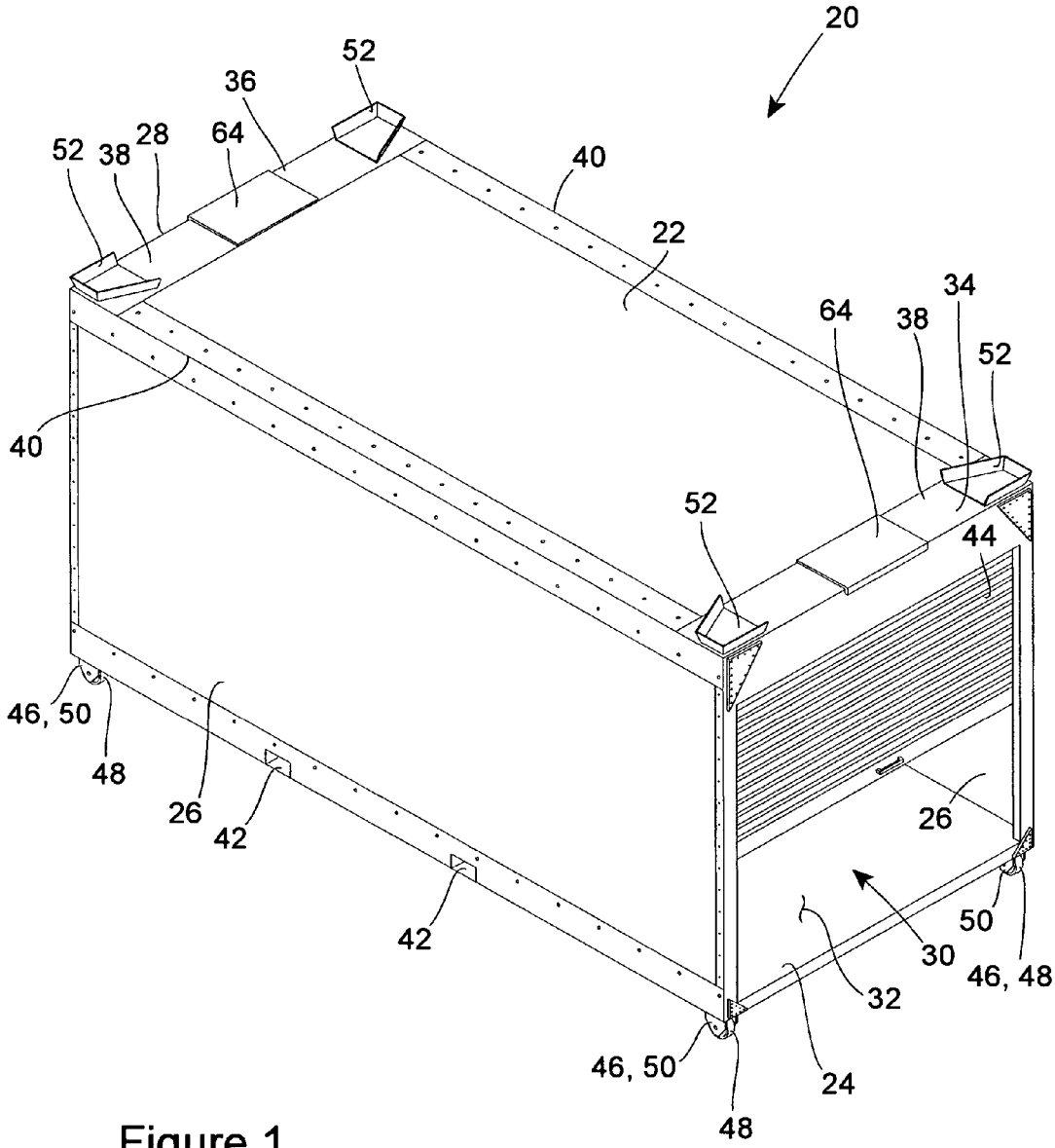
FIG. 1 is a perspective view of the preferred embodiment of a storage container in accordance with the invention.
Figure 2:
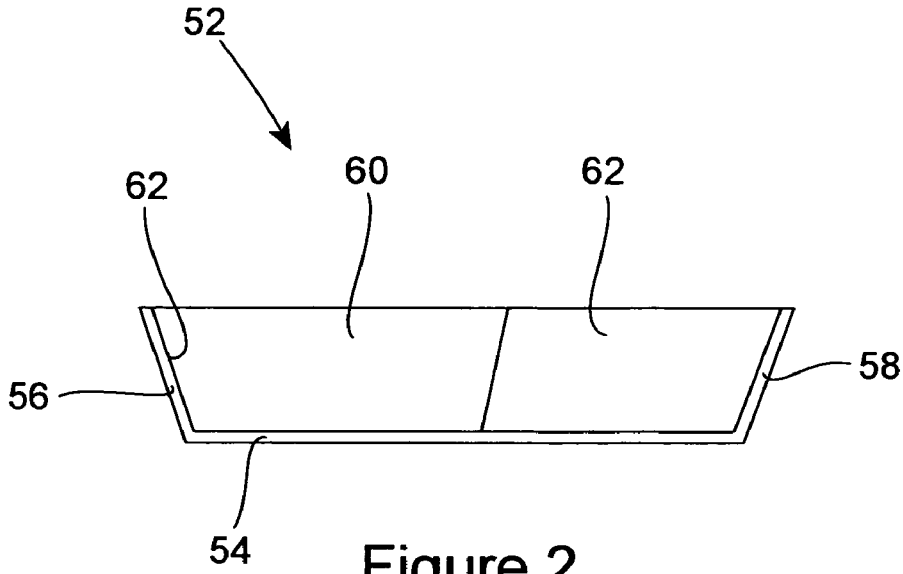
FIG. 2 is side elevation view of one of the protrusions mounted on top of the storage container shown in FIG. 1.
Figure 3:
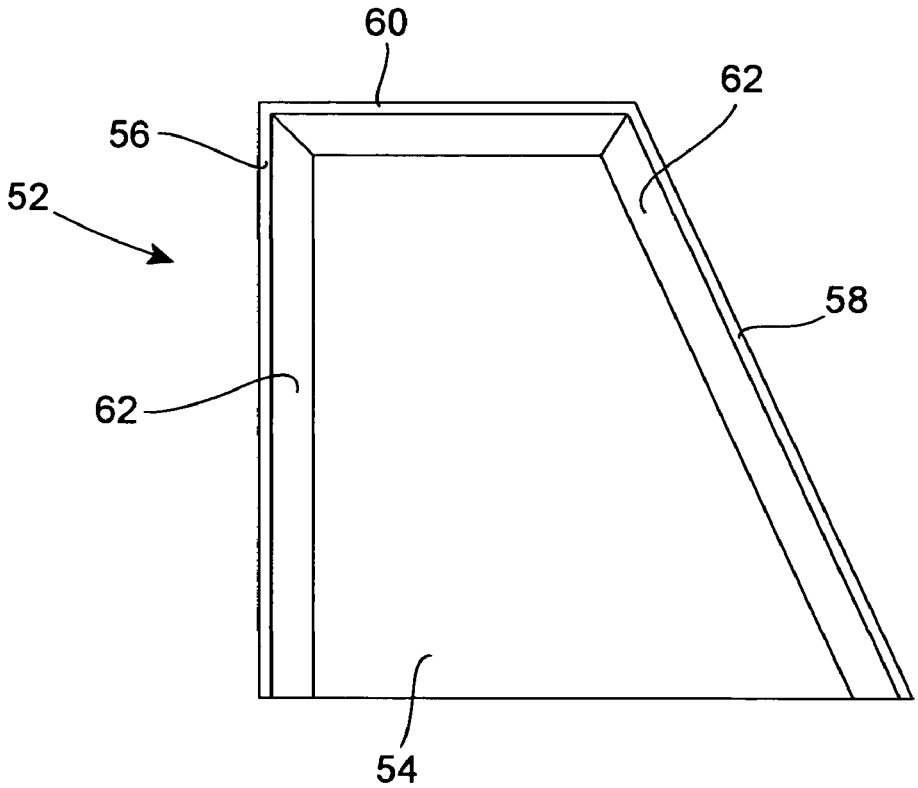
FIG. 3 is a plan view of the protrusion shown in FIG. 2.

Reference characters in the written specification indicate corresponding items shown throughout the drawing figures.

DETAILED DESCRIPTION OF THE PREFERRED EMBODIMENT OF THE INVENTION

The preferred embodiment of a walk-in storage and moving container is shown by itself in FIG. 1. The storage container 20 is preferably brick-shaped with a length of approximately sixteen feet, a width of approximately seven and a half feet, and a height of over eight feet. The storage container 20 comprises opposite top 22 and bottom 24 walls, opposite side walls 26, a rear wall 28, and a front doorway 30 that enclose a storage compartment 32.

The top wall 22 of the storage container comprises a translucent panel and stiffeners. The front edge margin 34 and the rear edge margin 36 of the top wall 22 each comprise a metal reinforcing members 38 that span from one of the side edges 40 of the top wall to the other of the side edges. The bottom wall 24 of the storage compartment 20 comprises ¾" marine grade plywood flooring, a plurality of metal stiffeners that span the width of the storage container, and a pair of metal stiffeners that span the length of the storage container. The bottom wall 24 further comprises a pair of tow lift tubes 42 that are longitudinally spaced four feet apart from each other and that each form a conduit from one of the side walls 26 to the other. The side walls 26 and the rear wall 28 of the container 20 preferably comprise fiber reinforced plastic paneling. A plurality of D-rings (not shown) are preferably attached to the side walls 26 in the interior of the storage compartment 32 to provide anchors for straps and the like used to secure items within the storage compartment. The doorway 30 of the storage container 20 provides ingress and egress into and out of the storage compartment 32 and preferably comprises an overhead door 44 that can be selectively opened and closed.

The storage container 20 also comprises a four supports 46 that extend down from the four corners of the bottom wall 24 of the storage container. Each support 46 preferably comprises a six inch diameter wheel 48 and a wheel mount 50. The supports 46 are configured to support the bottom wall 24 of the storage container 20 above a horizontal surface in a spaced apart manner. When the storage container 20 is at rest on a horizontal surface, the uppermost surface of the bottom wall 24 is preferably approximately eleven inches above the horizontal surface. Each support 46 is preferably capable of supporting at least three thousand pounds. The supports 46 are preferably oriented such that the wheels are able to rotate about axes that are parallel to the width of the storage container 20.

The storage container 20 also comprises four protrusions 52 that extend upward from the four corners of the top wall 22 of the container. Each protrusion 52 preferably comprise a horizontal baseplate 54 and first 56, second 58, and third 60 upturned walls. Each base plate 54 is preferably secured by fasteners to one of the metal reinforcing members 38 at either the front 34 or rear 36 edge margin of top wall 22. The first wall 56 of each protrusion is preferably oriented parallel to the width of the storage container 20 and is preferably welded to one end of the third wall 60 of the protrusion. The third wall 60 of each protrusion preferably extends parallel to the length of the storage container. The second wall 58 is preferably welded to the opposite end of the third wall 60 and preferably diverges away from the first wall 56 as the second wall extends away from the third wall. Each of the first 56, second 58, and third 60 walls of each protrusion 52 preferably also diverge away from each other as they extend upward from the baseplate 54. The baseplate 54 and the first 56 and second 58 walls of each protrusion are preferably formed from a single bent piece of quarter-inch metal sheet or plate and the third wall 60 is preferably welded thereto.

In addition to the above-mentioned components, the storage container 20 also preferably comprises a pair of metal bolster plates 64. One of the bolster plates 64 is attached to the exterior of the metal reinforcing member 38 at the front edge margin 34 of the top wall 22 and the other bolster plate is attached to the exterior of the metal reinforcing member at the rear edge margin 36 of the top wall. The bolster plates are preferably positioned centrally between the side edges 40 of the top wall 2. These bolster plates 64 help prevent the metal reinforcing members 38 from being damaged by hoists or cranes used to move the storage containers.

Figure 4:
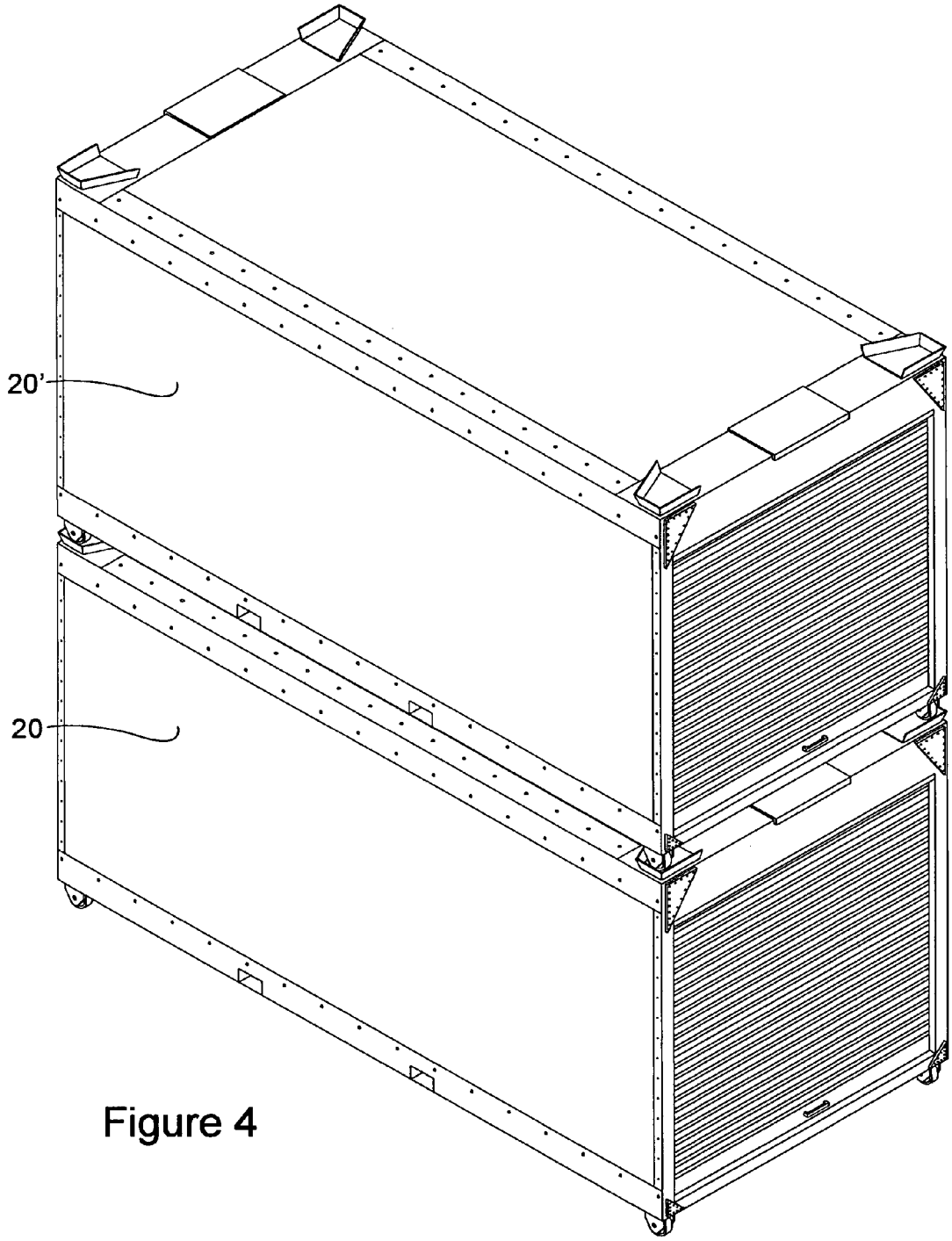
FIG. 4 is a perspective view showing a second storage container stacked on top of a first storage container.
Figure 5:
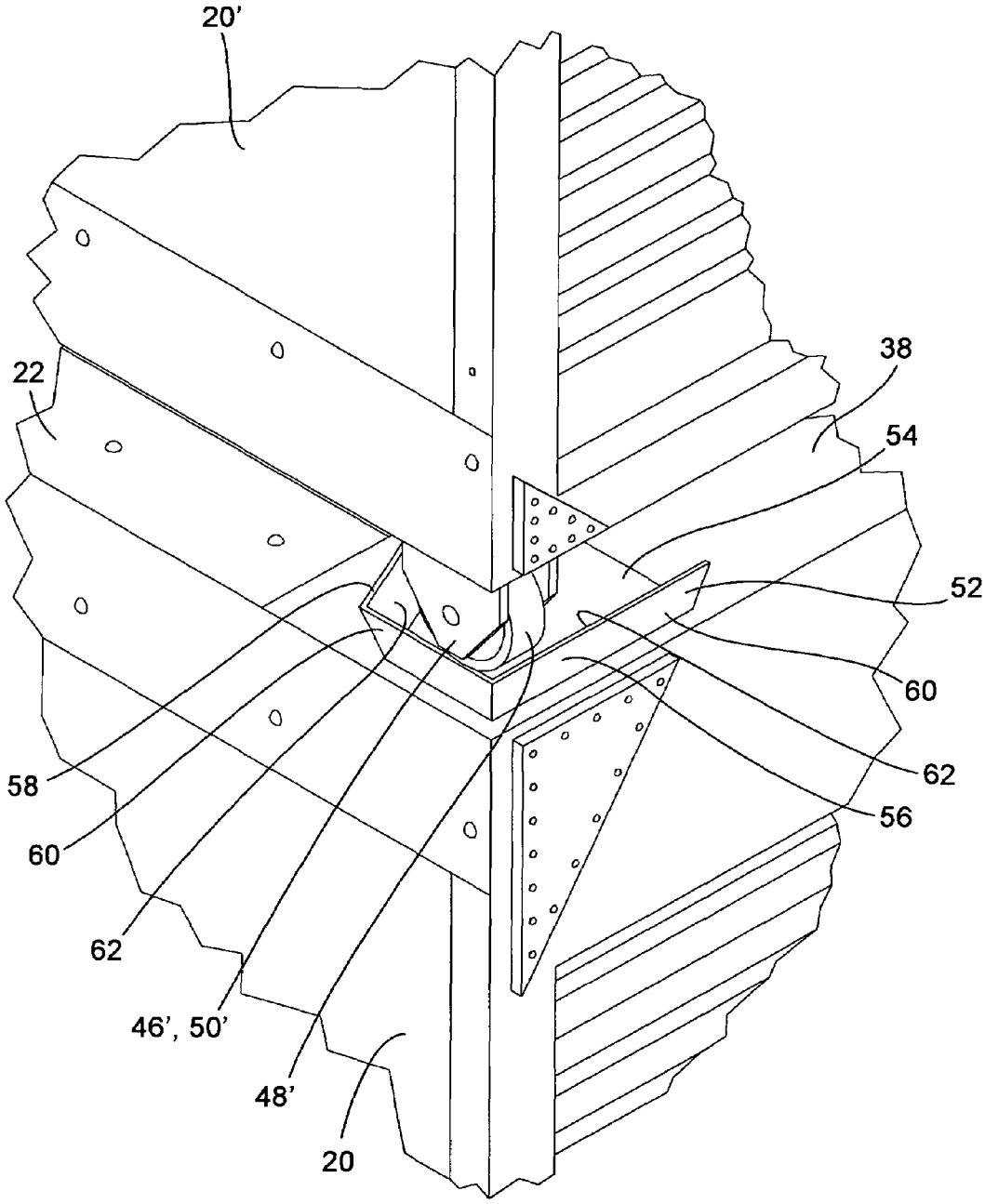
FIG. 5 is a detail view of FIG. 4 showing the relative position of one of the supports of the second container engaged with one of the protrusions of the first storage container.

The storage container 20 is utilized in substantially the same way as prior art storage containers. However, the storage container 20 is uniquely adapted to facilitate the stacking of another similar storage container thereon. Each storage container is preferably configured and adapted to support the fully loaded gross weight of two additional storage containers stacked thereupon. It should be appreciated that the stacking of storage containers on top of each other reduces the footprint area need to store the containers and is therefor beneficial in many situations. For purposes of this description, a second storage container 20' stacked upon the first storage container 20 is shown in FIG. 4 and in detail in FIG. 5.

When a second storage container 20' is stacked upon a first storage container 20, the supports 46' of the second storage container 20' rest on the baseplates 54 of the protrusions 52 of the first storage container 20. In such a stacked configuration, each support 46' of the second storage container 20' is positioned between the opposing faces 62 of the first 56 and second 58 walls of a protrusion 52 of the first storage container 20. As such, the protrusions 52 of the first storage container 20 act to limit horizontal translation of the second storage container 20' relative to the first storage container. This prevents the second storage container 20' from rolling or sliding longitudinally off of the first storage container 20. This also prevents the supports 46' of the second storage container 20' from damaging the relatively fragile translucent panel of the top wall 22 of the first storage container 20.

The configuration of the protrusions also facilitates the aligning of storage containers as such storage containers are being stacked on top of each other. As a storage container is stacked upon another storage container via a forklift, crane, hoist, or other device, the storage container can be tilted slightly about its lengthwise direction such that the supports adjacent one of its side walls will be positioned lower than the supports adjacent the other of the side walls. The upper storage container can then be stacked upon a lower storage container by moving the upper storage container over the first storage container in a direction generally parallel to its width. As this is done, the lowermost supports of the upper storage container are brought into engagement with the baseplates of the two corresponding protrusions of the lower storage container. Due to the tilt of the upper container, the uppermost supports of the upper storage container are able to clear the other two protrusion of the lower storage container. Because the first and second walls of each protrusion diverge from each other, the supports of the upper storage container can easily pass between the first and second walls of the corresponding protrusion even if the upper storage container is slightly longitudinally misaligned with the lower storage container. As the upper storage container is further moved into widthwise alignment with the lower storage container, the supports of the upper storage container move closer to the third wall of the corresponding protrusions, where the distance between the first and second walls of the protrusions are closer to each other. As such, any longitudinal misalignment between the storage containers will cause the second walls of the protrusions to engage supports of the upper storage container and thereby force the storage containers into longitudinal alignment. The third walls of the corresponding protrusions of the first storage container eventually engage the lowermost supports of the second container and thereby facilitate widthwise alignment of the storage containers. With the storage containers fully aligned, the second storage container can then be pivoted back to horizontal thereby bringing the other supports of the second storage container down into engagement the other corresponding protrusions of the lower storage container.

In a similar manner, alignment of storage containers is facilitated by the fact that the first, second, and third walls of each protrusion diverge away from each other as the extend upward. Because the walls of the protrusions are sloped in this manner, the protrusion of a first storage container will receive the supports of a second container being lowered thereon even if the containers are slightly misaligned. More specifically, as long as the supports of the upper storage container are positioned anywhere between the uppermost edges of the walls of the lower storage container's protrusions when the upper storage container is lowered, the sloped walls of the protrusions will guide the supports into their proper position on the lower storage container and thereby align the containers.

While the present invention has been described in reference to a specific embodiment, in light of the foregoing, it should be understood that all matter contained in the above description or shown in the accompanying drawings is intended to be interpreted as illustrative and not in a limiting sense and that various modifications and variations of the invention may be constructed without departing from the scope of the invention defined by the following claims. Thus, other possible variations and modifications should be appreciated.

Furthermore, it should be understood that when introducing elements of the present invention in the claims or in the above description of the preferred embodiment of the invention, the terms "comprising," "including," and "having" are intended to be open-ended and mean that there may be additional elements other than the listed elements. Similarly, the term "portion" should be construed as meaning some or all of the item or element that it qualifies.

What is claimed is:

1. A first storage container comprising:

a horizontally oriented rectangular bottom wall, the bottom wall having four corners, a front edge, a rear edge, and opposite side edges, the side edges having a length that defines a length of the first storage container, the front and rear edges having a length that defines a width of the first storage container;

a horizontally oriented rectangular top wall, the top wall having a front edge, a rear edge, and opposite side edges, the side edges of the top wall having a length equal to the length of the first storage container, the front and rear edges of the top wall having a length equal to the width of the first storage container;

opposite rectangular side walls, one of the side walls extending vertically from one of the side edges of the bottom wall to one of the side edges of the top wall and the other of the side walls extending vertically from the other of the side edges of the bottom wall to the other of the side edges of the top wall, each of the side walls having vertically oriented front and rear edges, the front and rear edges of the side walls having a height that defines a height of the first storage container;

a storage compartment bound by the top, bottom, and opposite side walls of the first storage container;

a doorway extending into the storage compartment from an environment external to the first storage container, the doorway being positioned between the front edge of the bottom wall and the front edge of the top wall and between the front edges of the side walls;

at least four supports, each of the supports extending down from the bottom wall adjacent one of the corners of the bottom wall, the supports being adapted and configured in a manner such that, when the first storage container is at rest on a horizontal surface, the bottom wall of the first storage container is spaced above and apart from the horizontal surface;

at least a first protrusion extending upward from the top wall of the first storage container, the first protrusion being configured and adapted to engage a first support of a second storage container that is identical to the first storage container, when such a second storage container is resting on top of the first storage container, in a manner limiting horizontal translation of the second storage container relative to the first storage container in at least first and second opposite directions, the first support of the second storage container corresponding to one of the supports of the first storage container, the first protrusion comprising a first and second wall that are horizontally spaced from each other, the first and second walls of the first protrusion diverge away from each other as they extend horizontally away from the side edge of the top wall nearest the first protrusion.

2. A first storage container in accordance with claim 1 wherein the length of the first storage container is greater than the width of the first storage container and the first and second directions are parallel to the side edges of the bottom wall of the first storage container.

3. A first storage container in accordance with claim 1 wherein the first protrusion is further configured and adapted to engage the first support of said second storage container, when such a second storage container is resting on top of the first storage container, in a manner limiting horizontal translation of the second storage container relative to the first storage container in a third direction that is perpendicular to the first and second directions.

4. A first storage container in accordance with claim 3 wherein the length of the first storage container is greater than the width of the first storage container and the first and second directions are parallel to the side edges of the bottom wall of the first storage container.

5. A first storage container in accordance with claim 1 wherein each of at least two of the supports of the first storage container comprises a wheel mounted to the first storage container for rotation relative thereto.

6. A first storage container in accordance with claim 5 wherein the length of the first storage container is greater than the width of the first storage container and the wheels of the at least two supports are able to rotate about a common axis of rotation, the axis of rotation being parallel to the front and rear edges of the bottom wall of the first storage container.

7. A first storage container in accordance with claim 1 wherein the four supports of the first storage container are adapted and configured in a manner such that, when the first storage container is at rest on a horizontal surface, the bottom wall of the first storage container is spaced a first distance above and apart from the horizontal surface, the first protrusion extends at most a second distance above the top wall, and the first distance is greater than the second distance.

8. A first storage container in accordance with claim 1 wherein the first wall of the first protrusion is adapted and configured to engage a first surface of the first support of the second storage container when such a second storage container is resting on top of the first storage container with the first support positioned between the first and second walls of the first protrusion in a manner limiting horizontal translation of the second storage container relative to the first storage container in the first direction, and the second wall of the first protrusion is adapted and configured to engage a second surface of the first support of the second storage container when such a second storage container is resting on top of the first storage container with the first support positioned between the first and second walls of the first protrusion in a manner limiting horizontal translation of the second storage container relative to the first storage container in the second direction.

9. A first storage container in accordance with claim 8 wherein the first and second walls of the first protrusion diverge away from each other as they extend upward from the top wall of the first storage container.

10. A first storage container in accordance with claim 9 wherein the four supports of the first storage container are adapted and configured in a manner such that, when the first storage container is at rest on a horizontal surface, the bottom wall of the first storage container is spaced a first distance above and apart from the horizontal surface, the first protrusion extends at most a second distance above the top wall, and the first distance is greater than the second distance.

11. A first storage container in accordance with claim 10 wherein each of at least two of the four supports of the first storage container comprises a wheel mounted to the bottom wall of the first storage container for rotation relative thereto.

12. A method comprising:

providing first and second storage containers, each of the first and second storage containers comprising a horizontally oriented rectangular bottom wall, the bottom wall having four corners, a front edge, a rear edge, and opposite side edges, the side edges having a length that defines a length of the respective storage container, the front and rear edges having a length that defines a width of the respective storage container, each of the first and second containers further comprising a horizontally oriented rectangular top wall, the top wall having a front edge, a rear edge, and opposite side edges, the side edges of the top wall having a length equal to the length of the respective storage container, the front and rear edges of the top wall having a length equal to the width of the respective storage container, each of the first and second containers further comprising opposite rectangular side walls, one of the side walls extending vertically from one of the side edges of the bottom wall of the respective storage container to one of the side edges of the top wall of said storage container and the other of the side walls extending vertically from the other of the side edges of the bottom wall of said storage container to the other of the side edges of the top wall of said storage container, each of the side walls having vertically oriented front and rear edges, the front and rear edges of the side walls having a height that defines a height of the respective storage container, each of the first and second containers further comprising a storage compartment bound by the top, bottom, and opposite side walls of the respective storage container, each of the first and second containers further comprising a doorway extending into the storage compartment from an environment external to the respective storage container, the doorway being positioned between the front edge of the bottom wall and the front edge of the top wall and between the front edges of the side walls, each of the first and second storage containers further comprising at least four supports, each of the supports extending down from the bottom wall of the respective storage container adjacent a different one of the corners of said bottom wall, the supports being adapted and configured in a manner such that, when the respective storage container is at rest on a horizontal surface, the bottom wall of said storage container is spaced above and apart from the horizontal surface, the first storage container further comprising at least a first protrusion extending upward from the top wall of the first storage container, the first protrusion of the first storage container further comprising first and second walls that are horizontally spaced from each other, the first and second walls of the first protrusion diverge from each other as they extend horizontally away from the side edge of the top wall of the first container nearest the first protrusion; and stacking the second storage container on top of the first storage container in a manner using at least the first protrusion to limit horizontal translation of the second storage container relative to the first storage container in at least a first direction by engaging a first one of the supports of the second storage container with the first wall of the first storage container.

13. A method in accordance with claim 12 wherein the step of stacking the second storage container on top of the first storage container occurs in a manner such that the first wall causes the second storage container to horizontally translate relative to the first storage container in a second direction as the second storage container is laid to rest on the first storage container, the second direction being opposite to the first direction.

14. A method in accordance with claim 12 wherein the step of providing the first and second storage containers occurs in a manner such that the first support of the second storage container comprises a wheel mounted to the bottom wall of the second storage container for rotation relative thereto, and the step of stacking the second storage container on top of the first storage container comprises using the first protrusion to limit horizontal translation of the second storage container relative to the first storage container in the first direction by engaging the wheel of the second storage container with the first wall of the first storage container.

15. A method in accordance with claim 12 wherein the step of stacking the second storage container on top of the first storage container comprises positioning the first support of the second storage container between the first and second walls of the first protrusion of the first storage container and using the second wall of the first protrusion to limit horizontal translation of the second storage container relative to the first storage container in a second direction by engaging the first support of the second storage container with the second wall, the second direction being opposite to the first direction.

16. A method in accordance with claim 15 wherein the step of stacking the second storage container on top of the first storage container comprises moving the second storage container in a manner such that the second storage container translates horizontally between the first and second walls of the first protrusion in a direction toward the side edge of the top wall of the first container nearest the first protrusion.

17. A method in accordance with claim 15 wherein the step of providing the first and second storage containers occurs in a manner such that the first and second walls of the first protrusion diverge away from each other as they extend upward from the top wall of the first container, and wherein the step of stacking the second storage container on top of the first storage container comprises lowering the second storage container relative to the first storage container in a manner such that the first support of the second storage container engages the first wall of the first protrusion as the second storage container is being lowered and thereafter the first wall of the first protrusion causes the second storage container to translate in the second direction until the second storage container has been completely lowered unto the first storage container.

* * * * *